US006538574B2

(12) United States Patent
Rossignol

(10) Patent No.: US 6,538,574 B2
(45) Date of Patent: Mar. 25, 2003

(54) DEVICE FOR SIGNALING THE POSITION OF AN ELEVATOR CAR IN THE CASE OF PASSENGER EVACUATION

(75) Inventor: Eric Rossignol, Minusio (CH)

(73) Assignee: Inventio AG, Hergiswil (CH)

( * ) Notice: Subject to any disclaimer, the term of this patent is extended or adjusted under 35 U.S.C. 154(b) by 19 days.

(21) Appl. No.: 09/835,911

(22) Filed: Apr. 16, 2001

(65) Prior Publication Data

US 2001/0035828 A1 Nov. 1, 2001

(30) Foreign Application Priority Data

| | | |
|---|---|---|
| May 1, 2000 | (EP) | 00810366 |
| Apr. 27, 2000 | (EP) | 00810363 |
| Aug. 25, 2000 | (EP) | 00810761 |

(51) Int. Cl.[7] ..... G08B 21/00

(52) U.S. Cl. ..... 340/686.1; 340/825.36; 340/687; 187/399

(58) Field of Search ..... 340/686.1, 687, 340/686.2, 825.49, 825.36; 116/64; 187/395, 399

(56) References Cited

U.S. PATENT DOCUMENTS

| | | | | |
|---|---|---|---|---|
| 4,102,437 A | * | 7/1978 | Mandel | 187/29 |
| 4,354,171 A | * | 10/1982 | Yoshida | 340/21 |
| 4,852,696 A | * | 8/1989 | Fukuda et al. | 187/139 |
| 4,894,522 A | * | 1/1990 | Elliott | 235/472 |
| 5,107,964 A | * | 4/1992 | Coste et al. | 187/104 |
| 5,194,702 A | * | 3/1993 | Swonger, Jr. | 187/139 |
| 5,398,783 A | * | 3/1995 | Jacoby | 187/395 |
| 5,532,529 A | * | 7/1996 | Codina et al. | 307/129 |
| 5,780,787 A | * | 7/1998 | Kamani et al. | 187/316 |
| 5,971,109 A | * | 10/1999 | Aulanko et al. | 187/263 |
| 6,193,019 B1 | * | 2/2001 | Sirigu et al. | 187/391 |

FOREIGN PATENT DOCUMENTS

| | | |
|---|---|---|
| DE | 296 15 921 | 4/1997 |
| EP | 0 839 754 | 5/1998 |

* cited by examiner

*Primary Examiner*—Benjamin C. Lee
*Assistant Examiner*—Phung T Nguyen
(74) *Attorney, Agent, or Firm*—MacMillan, Sobanski & Todd, LLC

(57) ABSTRACT

A device for signaling the position of an elevator car in the case of passenger evacuation includes a measurement circuit connected to a landing door safety chain of the elevator installation. The measurement circuit has at least one LED that indicates to a rescuer person the presence of the elevator car at a floor.

15 Claims, 3 Drawing Sheets

DEVICE FOR SIGNALING THE POSITION OF AN ELEVATOR CAR IN THE CASE OF PASSENGER EVACUATION

BACKGROUND OF THE INVENTION

The present invention relates generally to a device for signaling the position of an elevator car in the case of passenger evacuation, and particularly to a signal device that indicates the presence of the elevator car at a landing door of a floor.

The German utility model document DE 296 15 921 U1 describes a device that can be used for evacuating elevator passengers in a dangerous situation. The device is planned for elevator installations without a machine room, whereby the drive unit is positioned in the elevator shaft. If the elevator car is stuck in the shaft, the brake will be manually released and the car can reach the next floor, where the elevator passengers can leave the car without danger. The actuation of the brake is done by means of an actuator placed on a landing zone, where the elevator control unit also is located. During the evacuation operation the elevator car moves without electric power by means of the unequal balance between the car with the load and the counterweight.

A problem of the known device is that the person who actuates the brake must control the movement of the elevator car by means of the movement of the hoisting rope or of the over speed governor rope. Such control requires much experience and attention and can not be expected from an unpracticed person.

SUMMARY OF THE INVENTION

The present invention concerns a device that solves all of the above-cited problems of the prior art device, and provides a device that enables the evacuation of the elevator passenger safely and without danger.

An advantage of the device according to the present invention is that the evacuation procedure is easy and could be made also by an unpracticed person. Another advantage is that no window in the wall of the elevator shaft is needed to control the movement of the ropes and therefore of the car. Furthermore, no markings are needed on the ropes. By the device according to the present invention, no additional components are required in the shaft, and only the conventional components of the elevator installation are used.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
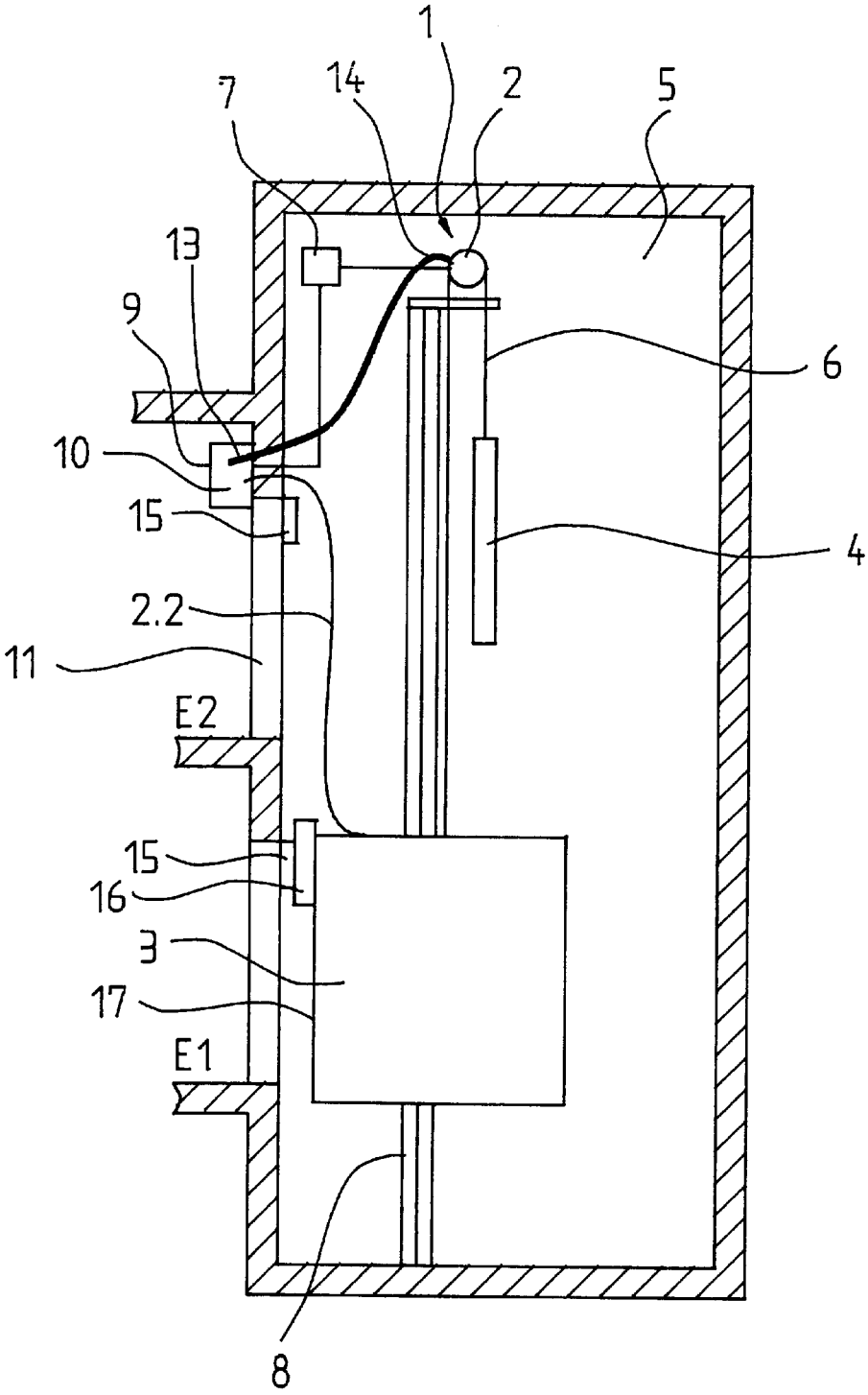
FIG. 1 is a schematic cross-sectional view of an elevator installation with an evacuation device according to the present invention.

FIG. 1 shows an elevator installation without a machine room and including an evacuation device according to the present invention. However, the evacuation device according to the present invention also can be applied to elevator installations with a conventional machine room. An elevator drive unit 1 with a drive sheave 2 moves an elevator car 3 and a counterweight 4 up and down in an elevator shaft 5 by means of ropes 6. The drive unit 1 is connected to and controlled by a drive control unit 7. The elevator car 3 moves along guide rails 8 extending vertically in the shaft 5. A controller cabinet 9 provided with an elevator control unit 10 is positioned on a floor E2 near a landing door 11. The elevator control unit 10 is connected to the drive control unit 7 and via a traveling cable 12 to the elevator car 3. The elevator control unit 10 controls the movement of the elevator car 3 and ensures the safety of the elevator installation.

Also in the controller cabinet 9 is a turnable element or handle 13 that is part of a mechanical power transmission element 14 consisting for instance in an axially rigid tube. One end of the power transmission element 14 is connected to the handle 13 and the other end of the power transmission element 14 is connectable with the drive sheave 2. In the example of FIG. 1, the elevator car 2 travels between a lower floor E1 and the upper floor E2. Obviously more than two floors can be served by the car 3. In the door zone of each floor are arranged door zone elements 15. In the embodiment of FIG. 1, the door zone elements 15 are positioned on the top of each landing door 11 and they are operated by the interaction with a corresponding actuation element 16 located on the elevator car 3, preferably on a car door 17. When the car 3 arrives at one of the floors E1 and E2, the corresponding actuation element 16 interacts with the door zone element 15. The presence of the car 3 at that given floor is then therefore detected. The detection of the car 3 will then be communicated/transmitted to the elevator control unit 10, as it will be described below. The interaction between the door zone element 15 and the corresponding actuation element 16 on the car 3 can for instance be mechanically, electrically or magnetically accomplished.

In one preferred embodiment, the door zone elements 15 interact with a landing door safety contact 18 (see FIG. 2) located on each landing door 11. All the landing door safety contacts 18 are connected in serial and are part of a conventional safety chain SC that takes care of the safety of the elevator installation. The state of the landing door safety contacts 18 is used by the signal device of the present invention to signal the presence of the car 3 at the associated one of the floors E1 and E2.

Figure 2:
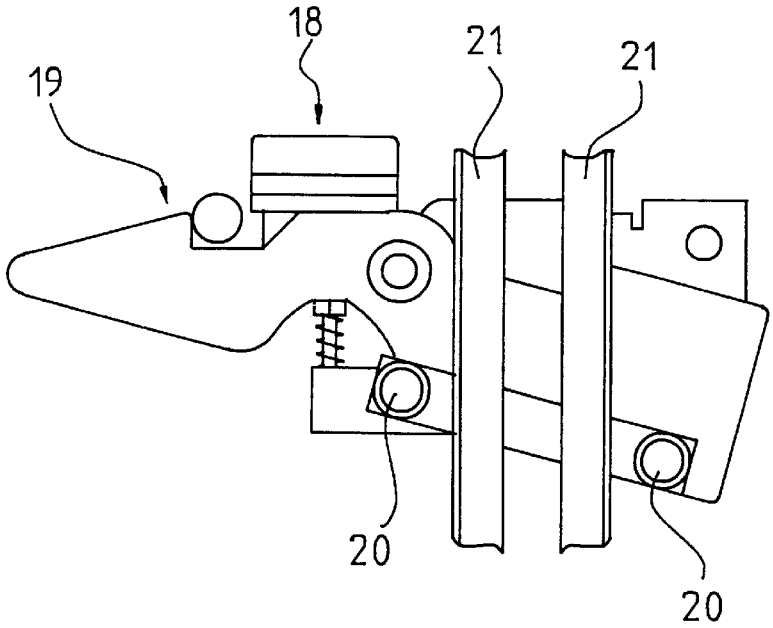
FIG. 2 is an enlarged side elevation view of a conventional door locking system of the elevator installation shown in FIG. 1.

FIG. 2 shows a conventional landing door locking system, which is well known by a person skilled in the art and which is preferably used by the evacuation device of the present invention. The landing door 11 has a lock 19 linked to the landing door safety contact 18 that is closed when the landing door 11 is locked and is opened when the landing door 11 is unlocked. The landing door 11 presents two rollers 20 acting as the door zone element 15 and the car door 17 is provided with two clamps 21 acting as the corresponding actuation element 16. The unlocking of the landing door 11 is actuated by the two clamps 21 of the car door 17 that push away the two rollers 20 mounted on the landing door locking system. When the car door 17 is locked, i.e. when the car is under power, the two clamps 21 are closed and do not push on the two rollers 20. When the car door 17 is unlocked (without power), the two clamps 21 open and push on the two rollers 20 that unlock the landing door, and the landing door safety contact 18 is then opened.

A measurement circuit MC is used in the signal device of the present invention. The measurement circuit MC is on a small printed circuit board (PCB not shown) and it is integrated into a conventional electric board of the elevator control unit 10 shown in FIG. 1. The measurement circuit MC has the objective to detect and signal the opening of the landing door safety contacts 18. This indication is needed by the rescuer person performing the manual evacuation of the passenger in case of elevator failure.

Figure 3:
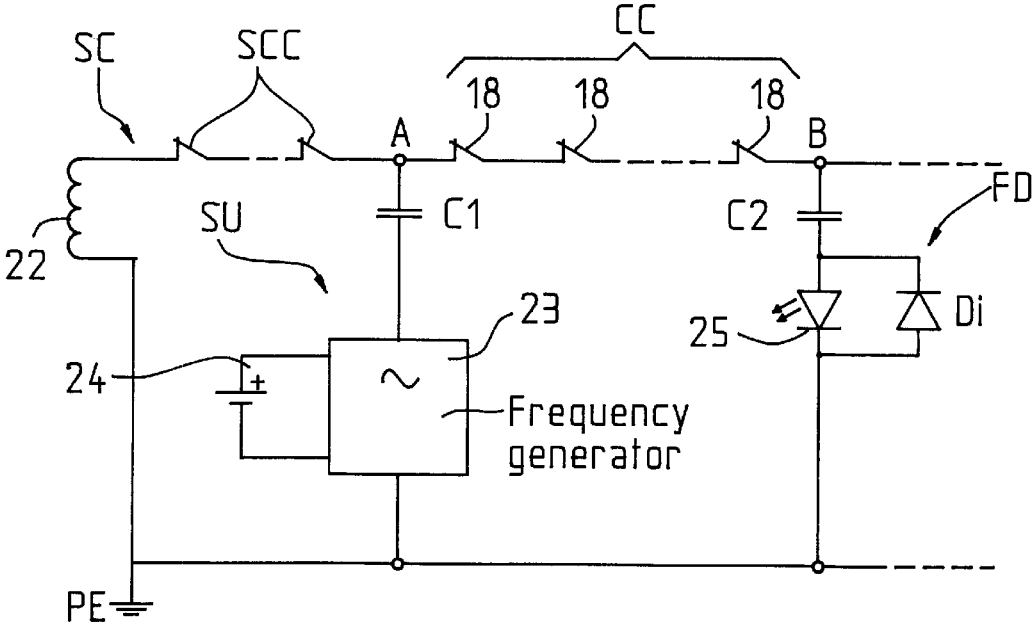
FIG. 3 is a circuit diagram of a signal device according to the present invention.

FIG. 3 is a schematic diagram of a first embodiment MC1 of the measurement circuit MC shown in FIG. 1. A safety chain supply 22 is connected serially to all of a plurality of safety chain contacts SCC of the safety chain SC. All the landing door safety contacts 18 are connected in series and form a chain of door contacts CC, which is therefore part of the safety chain SC. At the beginning of the chain of door contacts CC (a first measurement point A), and between the safety chain SC and a ground potential point PE (zero potential), there is connected a supply circuit SU comprising a frequency generator 23 in series with a first coupling capacitor C1. The frequency generator 23 is also connected to a battery or accumulator 24. At the end of the chain of door contacts CC (a second measurement point B) and between the safety chain SC and the ground potential point PE, there is connected a first detection circuit FD having a light emitting diode (LED) 25 connected in series with a second coupling capacitor C2. Connected in parallel with the LED 25 is diode Di for current flow in the opposite direction. The first detection circuit FD can also work with two LED's. If necessary, the capacitors C1 and C2 could be serially connected with resistors that are not shown in FIG. 2.

When all of the landing doors 11 are locked, the chain of door contacts CC is closed. When the car 3 is in a door zone, a mechanical system, for instance as disclosed in FIG. 2, makes the coupling between the car door 17 and the landing door 11, so when the car door 17 is unlocked, it unlocks the landing door too. When there is no power on the car door operator, the car door 17 is unlocked. According to this principle, if the car 3 moves in the shaft 5 without power on the door operator, when it arrives in the door zone, the car door 17 will unlock the landing door 11 and the landing door safety contact 18 will open. By measuring the opening of the landing door safety contact 18, it can detect when the car is in the door zone.

To measure the opening of the chain of door contacts CC, a signal is introduced at the point A at the beginning of the chain and the first detection circuit FD detects the presence of the signal at the point B at the end of the chain. The signal introduced at the beginning of the chain of contacts CC can be the safety chain supply 22 itself, if the main power is present, or a signal given by the frequency generator 23 supplied by the battery 24, if there is no main power. The frequency generator signal is introduced on the safety chain SC by means of the first coupling capacitor C1 that protects the frequency generator 23 against the normal voltage with low frequency of the safety chain SC. In this way the frequency generator 23 can stay connected permanently to the safety chain SC. An activation switch 26 (see FIG. 4) to switch on the battery 24 is optional. The second coupling capacitor C2 of the first detection circuit FD protects the LED 25 against the normal voltage of the safety chain SC, and permits the first detection circuit FD to be connected permanently. The first detection circuit FD and the frequency generator signal are defined so that the first detection circuit FD can work with both input signals: the normal safety chain supply signal and the frequency generator signal. The coupling capacitors C1 and C2 work as frequency depending resistors. Their resistance gets lower when the frequency gets higher.

Figure 4:
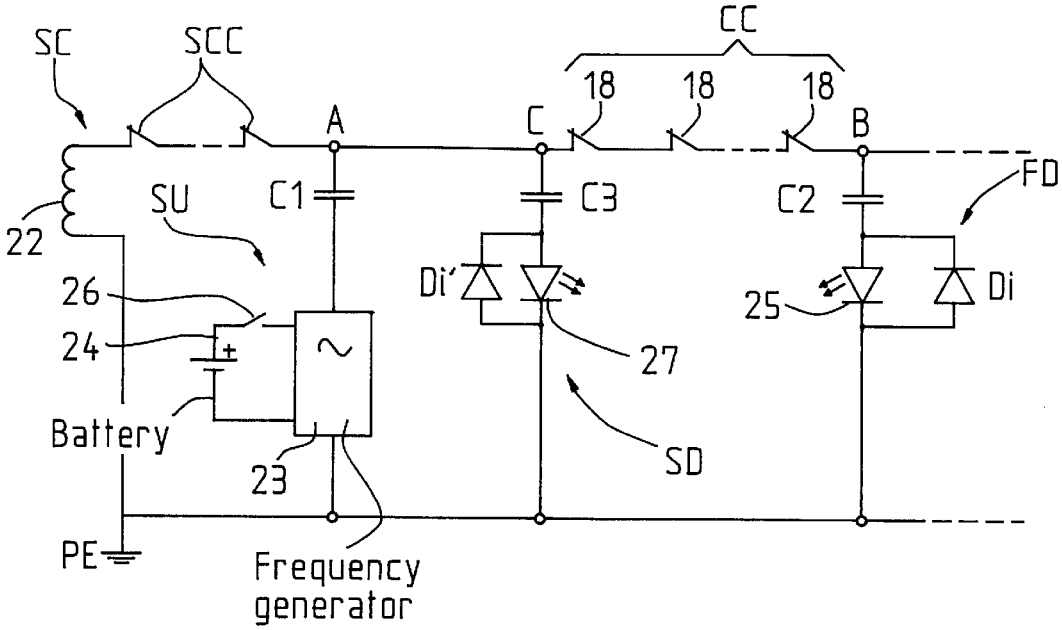
FIG. 4 is a circuit diagram of a signal device according to another embodiment of the present invention.

FIG. 4 is a circuit diagram of the measurement circuit MC in a second embodiment MC2 according to the present invention. The chain of contacts CC is supplied by the small battery 24. The battery 24 can be activated by the activation switch 26. On principle, the circuit diagram of FIG. 4 looks like the circuit diagram of FIG. 3, the difference consisting in a second detection circuit SD connected at a third measurement point C, at the beginning of the chain of door contacts CC, the point C at the same potential as the first measurement point A. The second detection circuit SD is connected in parallel with the supply circuit SU. The second detection circuit SD is connected between the safety chain SC and the ground potential PE and it is provided with an additional LED 27 and a third coupling capacitor C3 connected in series. Connected in parallel with the additional LED 27 is an additional diode Di' for current flow in an opposite direction. Also, here two LED's can be used. If necessary, the third capacitor C3 also can be serially connected to a resistor (not shown).

In operation, the additional LED 27 of the second detection circuit SD indicates that the measurement circuit MC2 is working. The LED 25 of the first detection circuit FD indicates that the car 3 is not at floor, i.e. if the LED 25 is lighted or "on", then the car is not at the floor, and if LED 25 is "off", then the car is at the floor.

The elevator installation can be provided with a recall control station, not shown, located in the controller cabinet 9. The recall control station can be operated for instance by aid of an up button and a down button also not shown.

The elevator shaft 5 is provided, as conventional, with shaft information elements KS (only one is shown as an example) that are used by the elevator car 3 to recognize its position in the shaft 5. The shaft information elements KS can for instance serve to see if the car 3 is in a deceleration zone or in the door zone. An indication device ID is connected to such shaft information elements KS and is located on the electric board of the controller cabinet 9. The indication device ID is lighted in two cases: when the car is in the door zone; and when the car is between two deceleration points. The indication device may be a further LED.

With reference to the embodiment shown in FIG. 4, the evacuation procedure includes following steps:

Without main power:

Switch on the battery 24 by the activation switch 26. The battery is now connected.

Move the car 3 slowly from the control cabinet 9 by checking the LED 25 and the additional LED 27. If the additional LED 27 is "on", the device is working.

Move the car until the LED 25 switches off. That indicates the car 3 is at the floor.

Switch off the battery 24.

With main power:

No need to switch on the battery 24, it is working with the safety chain supply 22, but if it is switched "on", it would not cause a problem.

Check the LED 25 and the additional LED 27.

Move the car 3 with the recall control station until the LED 25 switches "off". To see that the LED 25 switches "off", it is necessary to release the recall control station.

To find the door zone, move the car 3 10 cm at a time or look at the LED of the indication device ID connected to the shaft information elements KS when it is "on".

If by releasing of the recall control station, the LED 25 of the first detection circuit FD does not switch "off", then continue to move the car 3 with the recall control station until it reaches the next shaft information element KS. Then release the button and check the LED 25 (this time it should go off).

Figure 5:
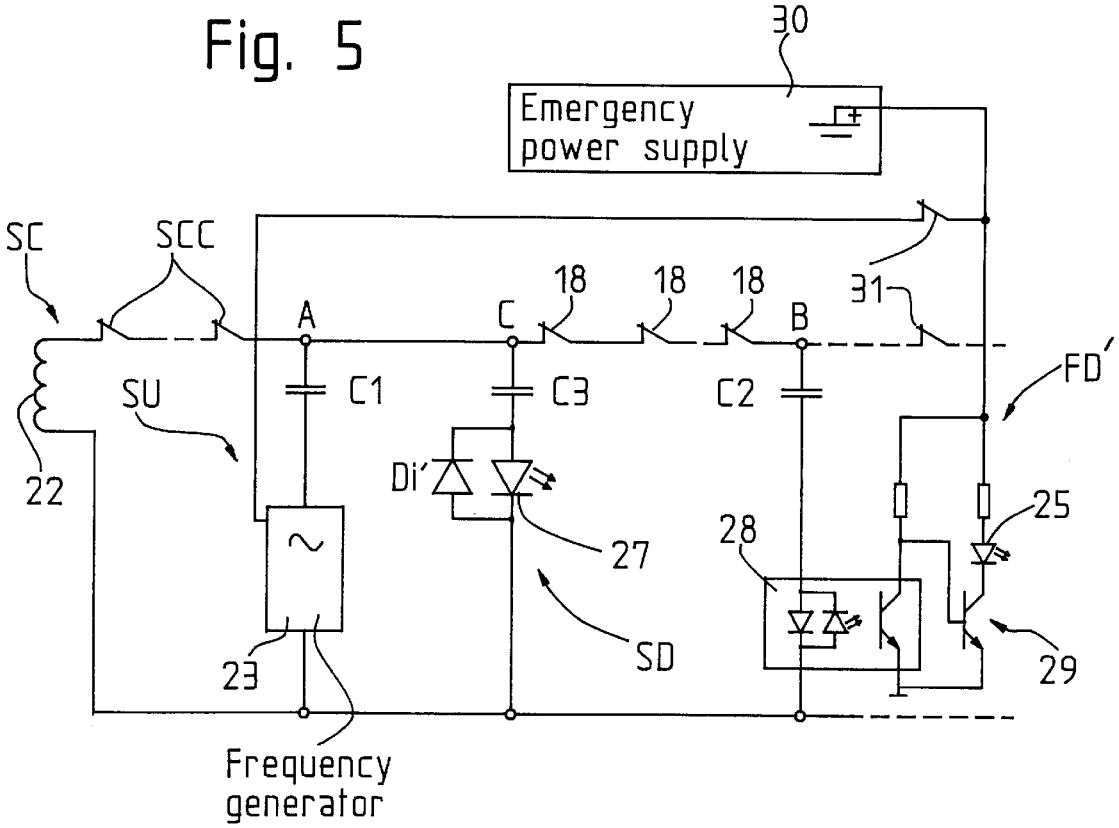
FIG. 5 is a circuit diagram of a signal device according to a further embodiment of the present invention.

FIG. 5 is a circuit diagram of the measurement circuit MC in a third embodiment MC3 of the signal device according to the present invention. A first detection circuit FD' includes the LED 25 connected to the second coupling capacitor C2 by means of an opto-coupler 28 and an inverter transistor 29. The inverter transistor 29 causes the LED 25 to turn "on" in the door zone and "off" outside the door zone. In that way the indication of the presence of the car 3 at a floor is signaled in a non-ambiguous way. The second coupling capacitor C2 is dimensioned so that the measuring circuit MC3 receives about the same nominal current with both signals, i.e. the signal of the safety chain supply 22 and that of the frequency generator 23. The second detection circuit SD is connected on the input of the chain of contacts CC at the third point C, in order to check the presence of the signal, i.e. the functioning of the measurement circuit MC3. The frequency generator 23 is supplied by an emergency power supply 30 of the elevator (12V DC). As the connection of the emergency power supply 30 with the frequency generator 23 is not part of the safety chain SC, it is disconnected in normal operation by a double safety contact 31 activated by the handle clutch system in the controller cabinet 9. When the handle 13 is engaged, the double safety contact 31 connects the emergency power supply 30 to the frequency generator 23 and opens the safety chain SC after the measurement circuit MC3, i.e. after the second measurement point B. This also avoids the measurement circuit MC3 discharging the emergency power supply 30 when not needed. When the double safety contact 31 disconnects the emergency power supply 30, it closes the safety chain SC after the measurement circuit MC3, so the safety chain SC is available. When the double safety contact 31 connects the emergency power supply 30, the safety chain SC is disconnected after the measurement circuit MC3. In this case, the safety chain SC is not required because the elevator is actually operated manually. The LED 25 of the first detection circuit FD' is permanently supplied by the emergency power supply 30 in order to work with the recall control station procedure. The opto-coupler 28 is needed to electrically isolate the emergency power supply 30 from the safety chain SC.

In this further embodiment, two evacuation procedures are possible:

a) With the recall control station if there is main power and the recall control station is available and working.

b) With the manual handle 13 when there is no main power, or if the procedure a) does not work.

Evacuation with manual handle 13:

Engage the manual handle 13.

Check that the additional LED 27 of the second detection circuit SD is "on".

Move the car 3 by turning the handle 13 in the preferred direction (depending on the car load) until the LED 25 of the first detection circuit FD' is "on".

The landing door 11 can now be opened manually and the passengers can evacuate.

Evacuation by aid of the recall control station:

With the recall control station, when the car 3 moves, the car door 17 is locked so that it will not unlock the landing door 11 by arriving at a floor and it is not possible to see whether the LED 25 on. To overcome this, it is necessary to use the indication device ID of the shaft information elements KS on the electric board (processor PCB) as described above.

The procedure is as follows:

Check that the additional LED 27 is "on".

Connect the recall control station and switch it in recall mode.

Move the car 3 by pressing the up or down button until the further LED of indication device ID on the electric board is "on".

Release the up or down button and check the LED 25.

If LED 25 is "on", the car is in the landing zone, and the landing door can be opened manually and the passengers can evacuate.

If the LED 25 is "off", repeat the procedure by moving the car 3 until it is at the next shaft information element KS (repeat this procedure from third step on).

The measurement circuit should be built to the following requirements:

No device can be connected in parallel on the safety chain SC.

The measurement circuit must be able to work with and without power.

The rescuer person should not have to perform any special action to activate the circuit.

The car in door zone indication should be indicated in a non-ambiguous way.

The LED 25 and the additional LED 27 should be different colors such as a red LED and a yellow LED respectively, or vice versa. The LED's 25 and 27 are low power consumption devices, preferably working with a current of 1 mA. The capacitors and the resistors are chosen so that a current of 1 mA can always pass therethrough for operating the LED's.

The following are examples of the calculation method used to determine the values of the components of the measurement circuit MC.

The values of the coupling capacitors C1, C2 and C3 are such as the normal safety chain supply ($U_n$, $F_n$) generates a nominal current I in the LED 25 of the first detection circuit FD, where $U_n$ is the voltage of the normal safety chain supply and $F_n$ is the frequency of the normal safety chain supply.

$$C2=1/(2\pi F_n Z) \text{ with } Z=U_n/I$$

To have the same current in the additional LED 27, C3=C2, and chose C1=C2.

The frequency of the generator 23 must be such as to generate the nominal current I in the LED 25 when there is no normal safety chain supply.

$$(1/(2\pi F_b C1)+1/(2\pi F_b C2))\cdot I=U_b$$

$F_b=I/(\pi C2\ U_b)$, whereby $U_b$ is the voltage of the frequency generator output signal and $F_b$ is the frequency of the frequency generator output signal.

As example, choose:

I=1 mA $U_b$=5 Vrms $U_n$=110 Vrms $F_n$=50 Hz

The formulas set forth above result in:

C2=29 nF $F_b$=2200 Hz

It obvious to a person skilled in the art that the embodiments of the inventions are not restricted to the examples described above, but various modifications within the scope of the attached claims can be envisaged. For example, instead of the LED's, light bulbs or filament bulbs can be used, obviously with the corresponding necessary adaptations (like resistors and/or capacitors) of the measurement circuit. Also an acoustic signal could be applied. This acoustic signal can be used in addition to the light signal or alternatively to the light signal.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for signaling the position of an elevator car during a passenger evacuation, comprising:

an elevator controller cabinet housing an elevator control unit associated with an elevator car;

a plurality of landing door safety contacts connected in series in a door contact chain, each said landing door safety contact being associated with a separate landing door at one of a plurality of floors served by the elevator car, each said landing door safety contact being normally closed and being opened in response to the presence of the elevator car at the associated landing door;

a source of electrical power connected to one end of said door contact chain; and a detection circuit mounted in said cabinet and being connected to an end of said door contact chain opposite said electrical power source, said detection circuit being responsive to power provided by said electrical power source for indicating to a rescuer person a presence of the elevator car at one of the landing doors, said detection circuit generating a first indication signal when all said landing door safety contacts are closed representing an absence of the elevator car from the landing doors and generating a second indication signal when one of said landing door safety contacts is open representing a presence of the elevator car at the associated landing door.

2. The device according to claim 1 wherein said detection circuit includes at least one LED that is lighted to generate: said first indication signal.

3. The device according to claim 2 wherein said one LED is turned off to generate said second indication signal.

4. The device according to claim 1 wherein said electrical power source includes a safety chain power supply connected to said one end of said door contact chain and a frequency generator connected to said one end of said door contact chain, said safety chain power supply and said frequency generator each providing electrical power to said detection circuit.

5. The device according to claim 4 including another source of electrical power connected to said frequency generator for providing power to said frequency generator.

6. The device according to claim 5 wherein said another source of electrical power is one of a battery an emergency power supply of the elevator control unit.

7. The device according to claim 1 wherein said detection circuit is a first detection circuit and including a second detection circuit connected to said one end of said door contact chain for indicating tat said first detection circuit is operational.

8. The device according to claim 7 wherein said second detection circuit includes at least one LED that is lighted to generate an operating signal indicating tat said first detection circuit is operational.

9. The device according to claim 8 wherein said one LED is turned off to indicate that said first detection circuit is not operational.

10. A device for signaling the position of an elevator car in an elevator installation during a passenger evacuation, the elevator installation including a plurality of landing door safety contacts connected in series in a door contact chain, each of the landing door safety contacts being associated with a separate landing door at one of a plurality of floors served by the elevator car, each of the landing door safety contacts being normally closed and being opened in response to the presence of the elevator ear at the associated landing door; comprising:

a source of electrical power connected to one end of a door contact chain; and a detection circuit adapted to be connected to an end of the door contact chain opposite said electrical power source, said detection circuit being responsive to power provided by said electrical power source for indicating to a rescuer person adjacent a controller for an elevator car a presence of the elevator car at one of the landing doors, whereby when said electrical power source and said detection circuit are connected to the door contact chain, said detection circuit generates a first indication signal when all the landing door safety contacts of the door contact chain are closed representing an absence of the elevator car from the landing doors and generates a second indication signal when one of the landing door safety contacts is open representing a presence of the elevator car at the associated landing door.

11. The device according to claim 10 wherein said detection circuit includes at least one LED that is lighted to generate said first indication signal and is turned off to generate said second indication signal.

12. The device according to claim 10 wherein said detection circuit includes at least one LED that is lighted to generate said first indication signal, an inverter transistor connected in series with said one LED, an opto-coupler for actuating said inverter transistor and a capacitor connected between said door contact and said opto-coupler.

13. The device according to claim 10 wherein said electrical power source includes a frequency generator connected to the door contact chain through a capacitor.

14. The device according to claim 10 wherein said electrical power source includes adjacent an elevator control unit associated with the elevator car.

15. A device for signaling the position of an elevator car during a passenger evacuation, comprising:

a plurality of landing door safety contacts connected in series in a door contact chain, each said landing door safety contact being associated with a separate lauding door at one of a plurality of floors served by the elevator ear, each said landing door safety contact being normally closed and being opened in response to the presence of the elevator car at the associated landing door;

a source of electrical power connected to one end of said door contact chain; and a detection circuit connected to an end of said door contact chain opposite said electrical power source and mounted remotely from an area of the landing doors, said detection circuit being responsive to power provided by said electrical power source for indicating to a rescuer person a presence of the elevator car at one of the landing doors, said detection circuit generating a first indication signal when all said landing door safety contracts are closed representing an absence of the elevator car from the landing doors and generating a second indication signal when one of said landing door safety contacts is open representing a presence of the elevator car at the associated landing door.

* * * * *